US007562400B2

(12) United States Patent
Graham

(10) Patent No.: US 7,562,400 B2
(45) Date of Patent: Jul. 21, 2009

(54) MOBILE EQUIPMENT FOR NON-AMBULATORY PEOPLE

(75) Inventor: Margaret E. Graham, New York, NY (US)

(73) Assignee: Qua, Inc., New Rochelle, NY (US)

( * ) Notice: Subject to any disclaimer, the term of this patent is extended or adjusted under 35 U.S.C. 154(b) by 692 days.

(21) Appl. No.: 11/207,608

(22) Filed: Aug. 19, 2005

(65) Prior Publication Data

US 2006/0037130 A1 Feb. 23, 2006

Related U.S. Application Data

(60) Provisional application No. 60/603,376, filed on Aug. 20, 2004.

(51) Int. Cl.
*A47K 11/06* (2006.01)
*A61G 7/02* (2006.01)

(52) U.S. Cl. ..... 4/480; 4/483; 4/484

(58) Field of Classification Search ..... 4/480, 4/484, 479, 482, 483
See application file for complete search history.

(56) References Cited

U.S. PATENT DOCUMENTS 3,693,193 A * 9/1972 May ..... 4/484
5,058,222 A 10/1991 Workman et al.
5,062,165 A * 11/1991 Kerr ..... 4/480
5,384,920 A * 1/1995 Havens ..... 4/480
5,947,501 A 9/1999 Osborn
6,036,216 A 3/2000 Osborn
6,128,790 A 10/2000 Brayda Di Soleto
6,154,690 A * 11/2000 Coleman ..... 701/1

* cited by examiner

*Primary Examiner*—Tuan N Nguyen
(74) *Attorney, Agent, or Firm*—Kalow & Springut LLP

(57) ABSTRACT

A mobile equipment service device for use by non-ambulatory persons. The device can be a manually movable commode for permitting such persons to independently access a system to contain waste, seal the waste, prevent odors for emanating into the room, and permit later removal and disposal of the waste. The system may also introduce an odor absorbent material into the sealed area where the waste is retained. In a further embodiment, a programmable device, such as a commode, can be remotely operated by the person, increasing the person's ability to independently access and use the device by moving the device to and from that person, and then securing that device to permit safe use by those persons. Preferably, the programmable device is battery powered so as to be self-propelled. In addition, the device contains a data collection system that collects data on use, and transmits that data as directed to location.

27 Claims, 13 Drawing Sheets

MOBILE EQUIPMENT FOR NON-AMBULATORY PEOPLE

CROSS REFERENCE TO RELATED APPLICATION

The present application claims the priority of co-pending provisional application U.S. Ser. No. 60/603,376, filed on Aug. 20, 2004, and the disclosure of this application is incorporated by reference herein its entirety. Applicant claims the benefits of this application under 35 U.S.C. § 119(e).

FIELD OF THE INVENTION

The present invention relates to mobile devices for the needs of persons. In particular, the present invention relates to mobile devices that may be programmable to facilitate use by a person.

BACKGROUND OF THE INVENTION

Many people are left immobile for a time after surgery and/or medical treatment. While they may be able to sit up in bed or function in a wheelchair, walking across the room to use the bathroom or to reach other items in their room can be a strenuous and/or painful activity. This applies to other immobile persons located anywhere along the continuum of care, including, but not limited to, acute/sub-acute rehabilitation institutions, nursing homes, or in their own homes.

U.S. Pat. No. 6,725,485 to Hayes discloses a mattress provided with a cavity having a controlled expandable cushion. A bedpan can be placed inside the cavity prior to use, and when used, the cushion expands to be in line with the rest of the mattress. The mattress can also be arranged with a bidet system for added hygiene of the person, which cleans the area of the lower body that is exposed in the cavity. This bedpan arrangement is most useful for those persons who have no mobility and cannot sit up. While a bedpan directly in the bed is convenient, it is not the most hygienic arrangement. The non-ambulatory person may not want to be lying on a bedpan all day, and may only want to have a bedpan close by when it is needed. However, that same person may be capable of some movement, or in a wheelchair, but will want to reduce the number of times that they need to walk from the bed or get up from the wheelchair without assistance in order to prevent aggravation of their injury/condition. The caregiver is required to assist people of limited mobility to the facilities for necessary biological functions. Some health care worker's schedule is dictated by the needs of the people under their care. It can be costly to have someone on duty 24 hours a day to assist as peoples needs arise.

Furthermore, a non-ambulatory person may not have access to many other items in his or her room because of lessened mobility. Therefore, there is a need for providing autonomy and self-help to persons with limited ambulation, allowing them to access here-to-fore stationary items while minimizing the risk of injury or strain. There is also a need to increase the productivity of healthcare providers/caregivers by substituting labor with controllable mechanical interventions.

SUMMARY OF THE INVENTION

The present invention provides a programmable or mobile device, including health services equipment such as commodes, whose own features can be adapted in a user-friendly manner, and can be manipulated by those non-ambulatory users, including those persons confined to beds and wheelchairs, providing new autonomy to people who would otherwise be dependent on others for activities of daily living. The invention is designed to be non-obtrusive in the environment. It will not need caregiver attention or manipulation for extended periods of time. The commode version contains a multiple use disposable waste containment system. In addition, the present invention provides new opportunities to perform point-of-care testing, checking vital signs, and otherwise enhancing individualized healthcare monitoring.

BRIEF DESCRIPTION ON THE DRAWINGS

Other advantages of the present invention will be readily appreciated as the same become better understood by reference to the following detailed description when considered in connection with the accompanying drawings, wherein.

Figure 8A:
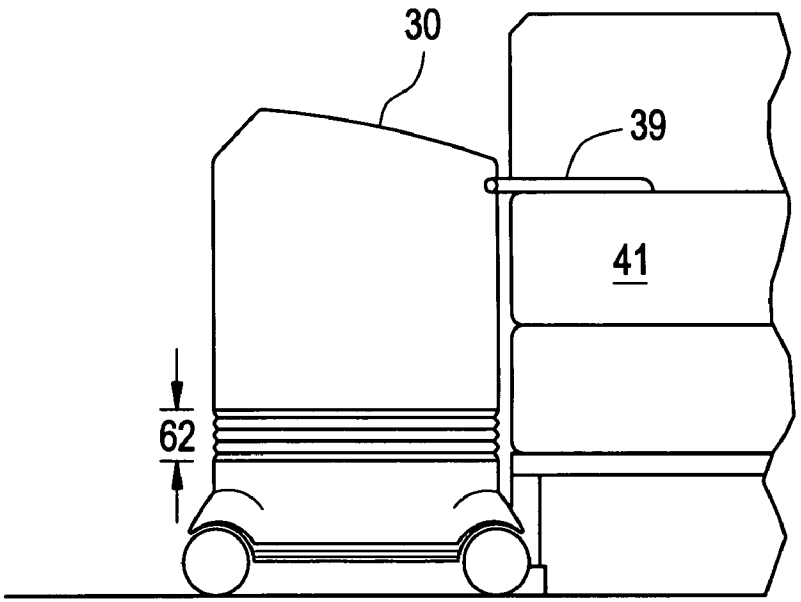
FIG. 8 is a front view of the commode embodiment in an open position near a tall bed.
Figure 9:
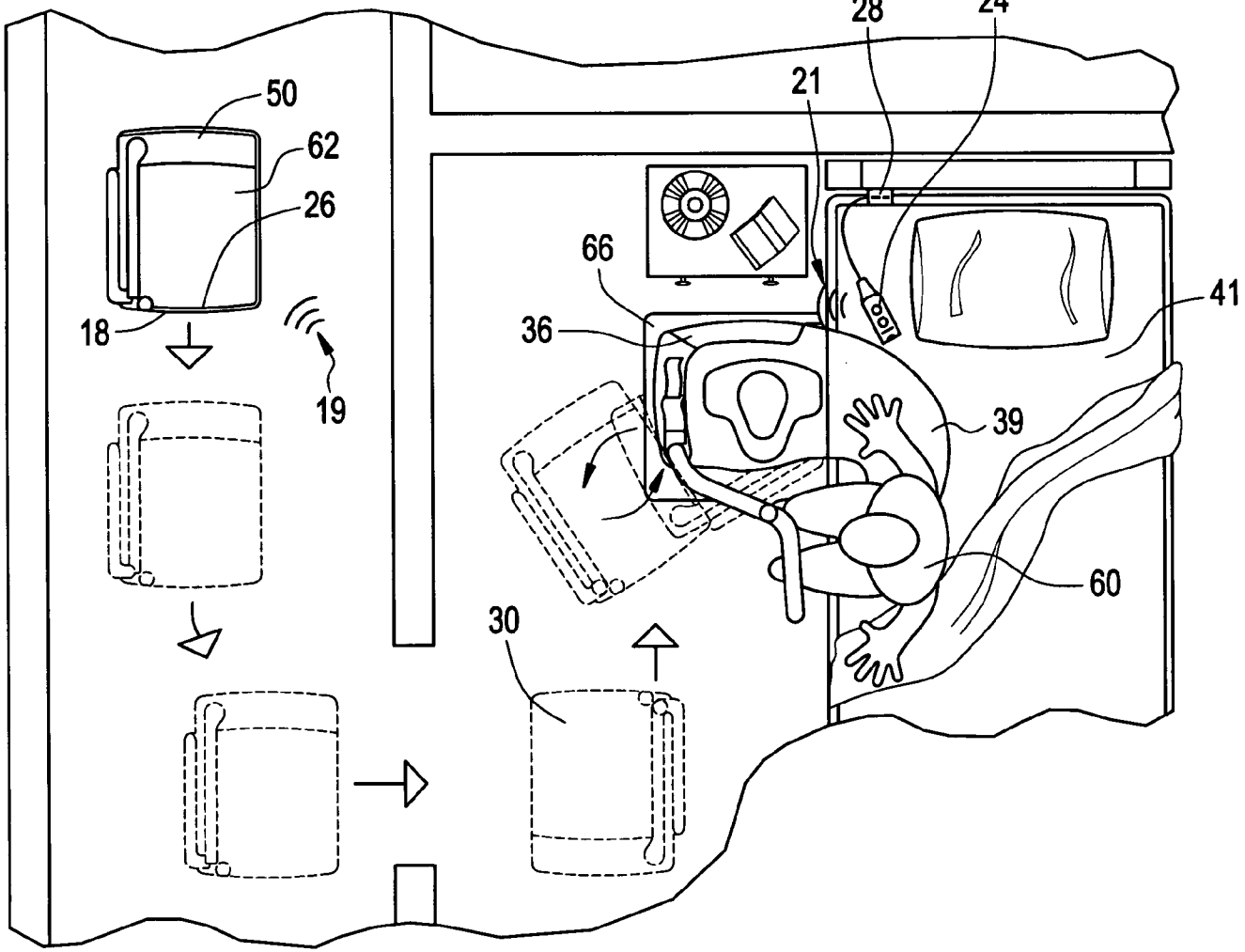
Figure 10:
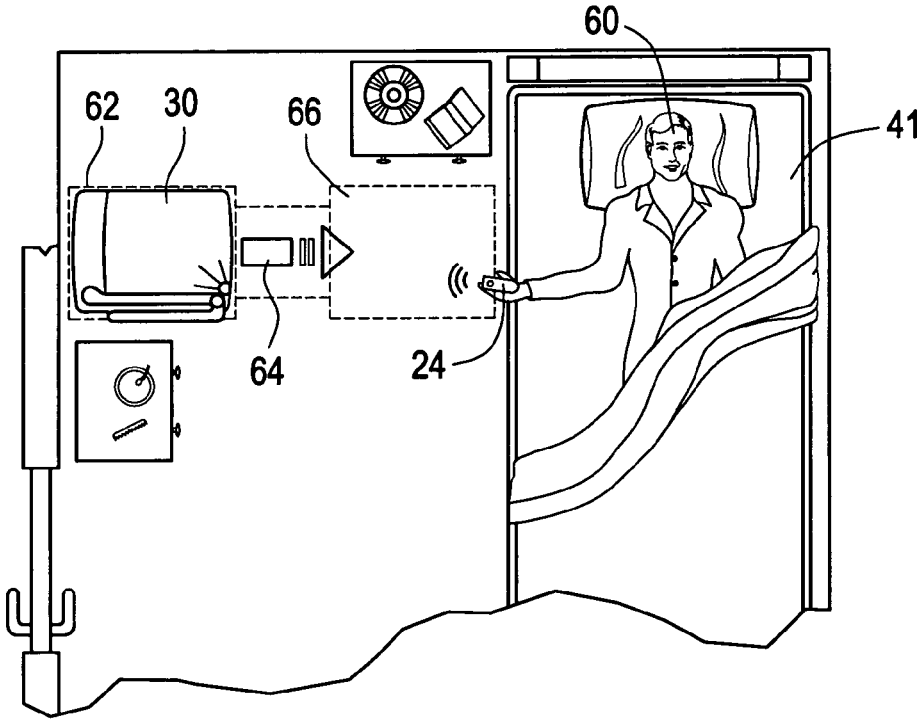
Figure 10A:
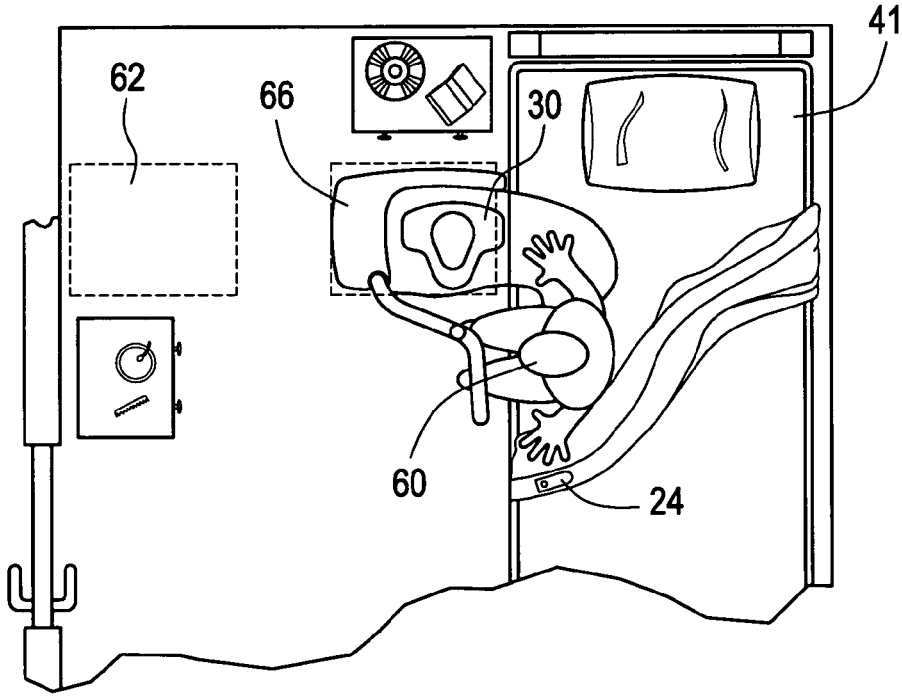
Figure 11:
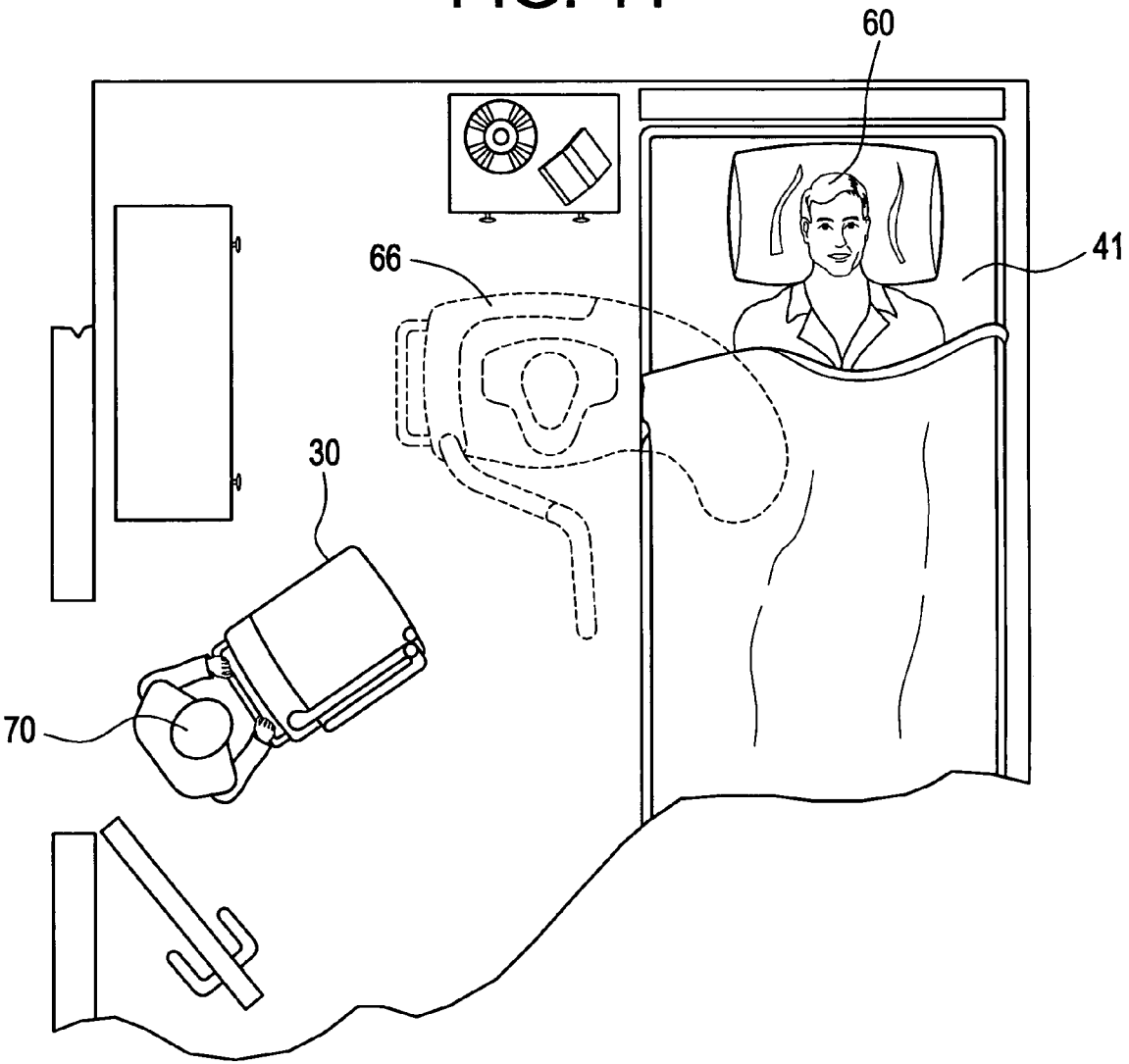
Figure 12:
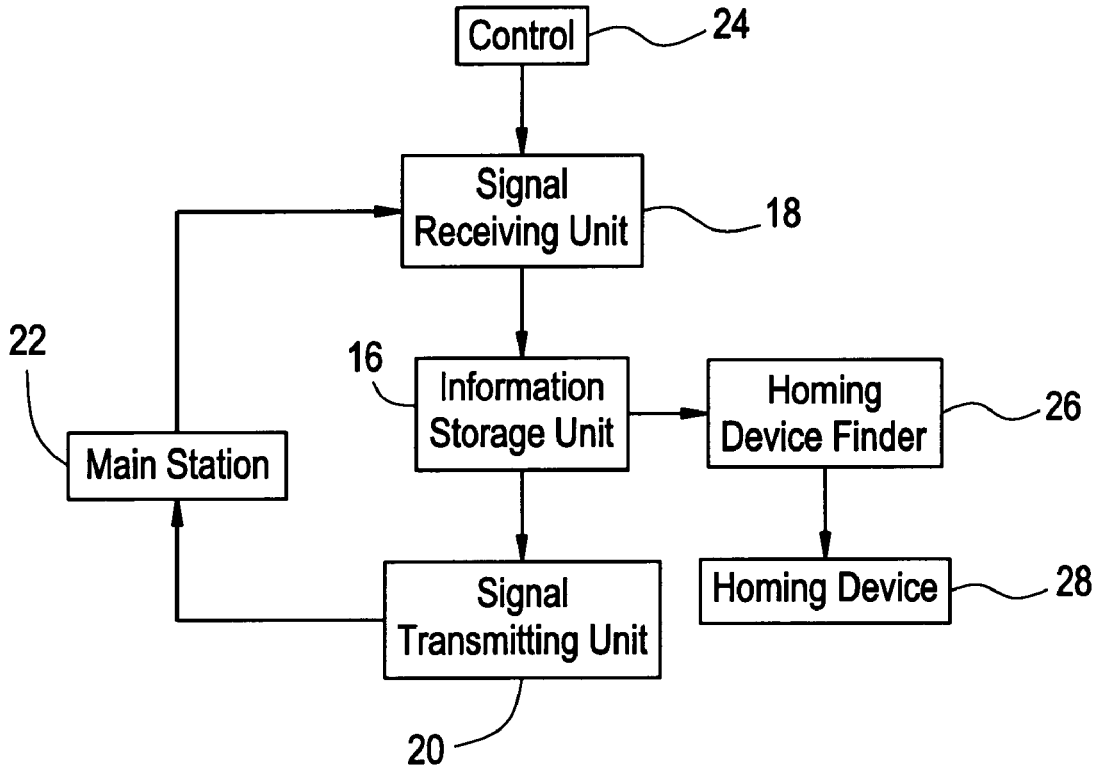

FIG. 8*a* is a front view of the commode embodiment in an open position near a short bed;

FIG. 9 is a diagram of the movement of a mobile device in a patient's room for a fully automated unit;

FIG. 10 is a diagram of the movement of a mobile device in a patient's room for a semi automated unit from a home position;

FIG. 10*a* is a diagram of the movement of a mobile device in a patient's room for a semi-automatic unit in a usage position;

FIG. 11 is a diagram of the movement of a mobile device in a patient's room for a manual unit; and FIG. 12 is a flowchart depicting the flow of information and signals between a control, a unit, a homing device, and a main station.

DETAILED DESCRIPTION OF THE INVENTION

The present invention provides a new and improved apparatus for aiding a non-ambulatory person, created by using single-use features of a piece of equipment to make that equipment accessible to the user without need for other assistance and more useful to the healthcare provider/caregiver.

Figure 1:
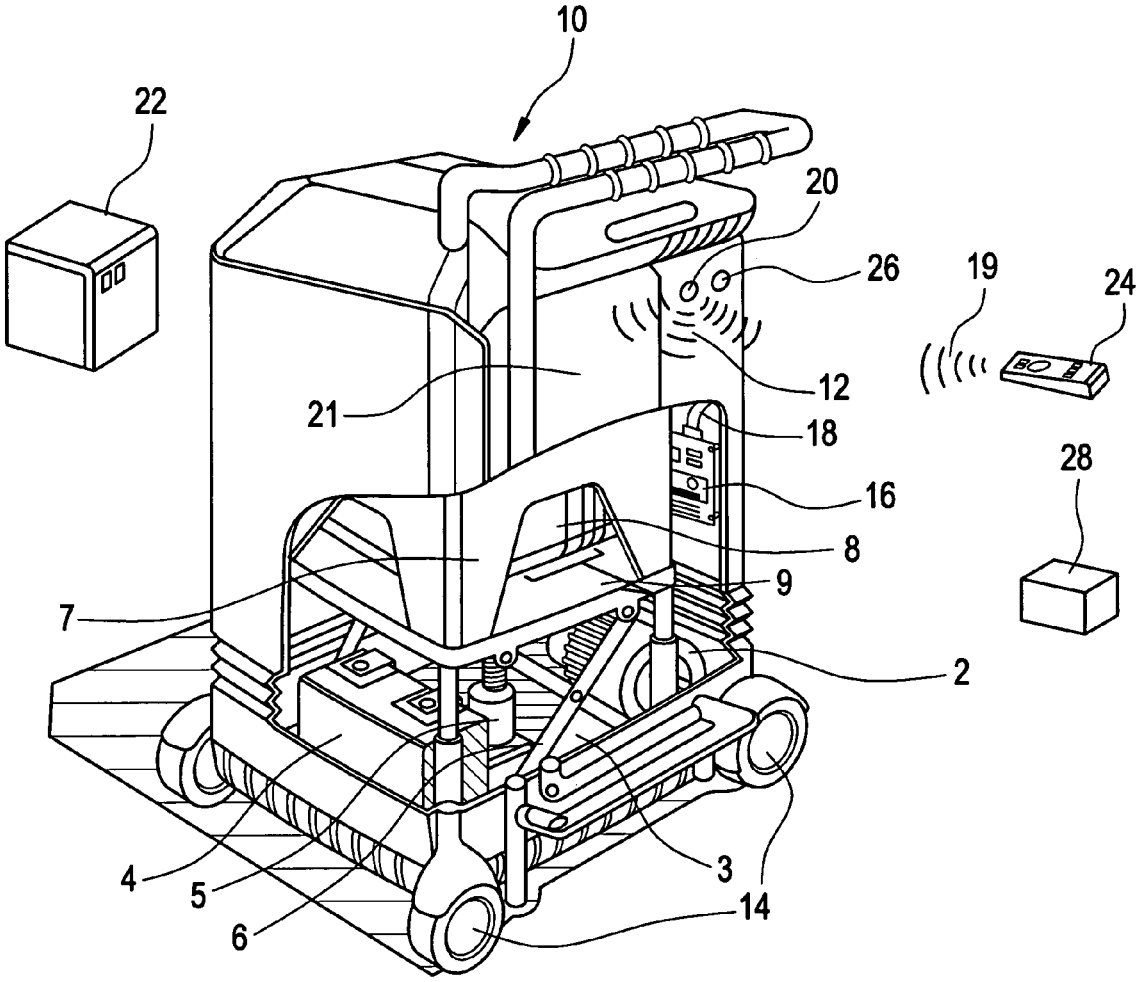
FIG. 1 is a perspective view, partially cut away, of a mobile programmable device showing its internal components.
Figure 1A:
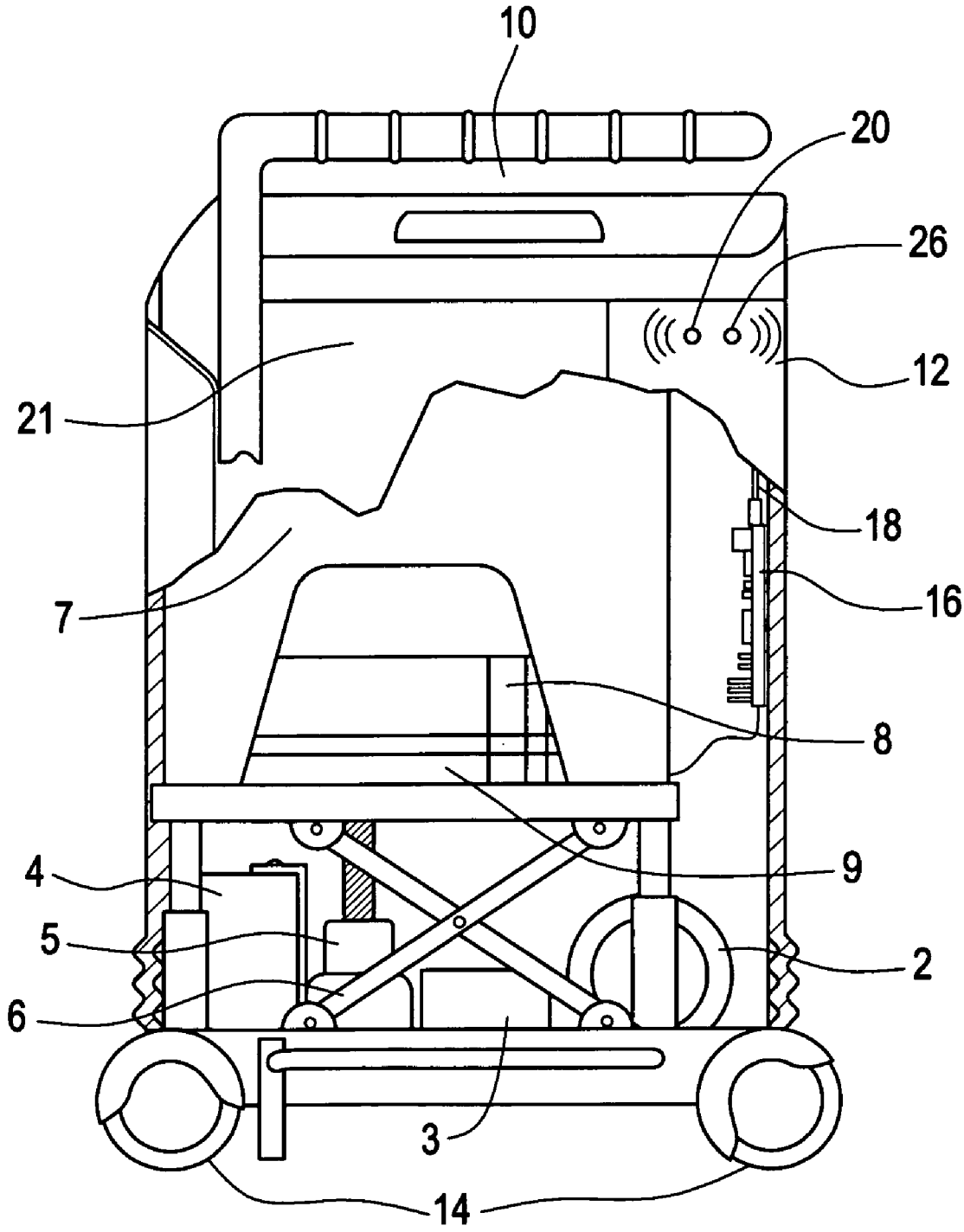
FIG. 1A is a side view, partially cut away, of the mobile programming device of FIG. 1.

A mobile programmable device 10, as shown generally in FIGS. 1 and 1A, includes a unit 12 having at least one movable member 14 operatively attached to the unit 12. A user may operate a control 24, which sends an outgoing signal 19 to the unit 12. The unit 12 also may include an information storage unit 16, a signal receiving unit 18 for accepting an incoming signal 19 from the control 24 or a main station 22 and a signal transmitting unit 20 for sending an out going signal 21 to the main station 22. Further, this equipment may include sensor 9 that transmits information about the equipment status to the information storage unit 16. The unit 12 further may include a homing device finder 26 that can locate a homing device 28. The unit may include height adjustment as seen with drive motor 5 and jack features 6. The unit may include a motor for propelling itself as represented by drive motor 2.

The units will have an equipment compartment 7 which contains the equipment 8. The unit may be powered by a battery 4 that is preferably rechargeable. The battery type may be lead acid, NiMH, NiCad, Lithium or other. The location of the equipment, motors and batteries are placed to encourage stability and a low center of gravity. The unit 12 may also include a ballast weight 3 in the base for stability. The unit 12 can take on several different embodiments.

Figure 2:
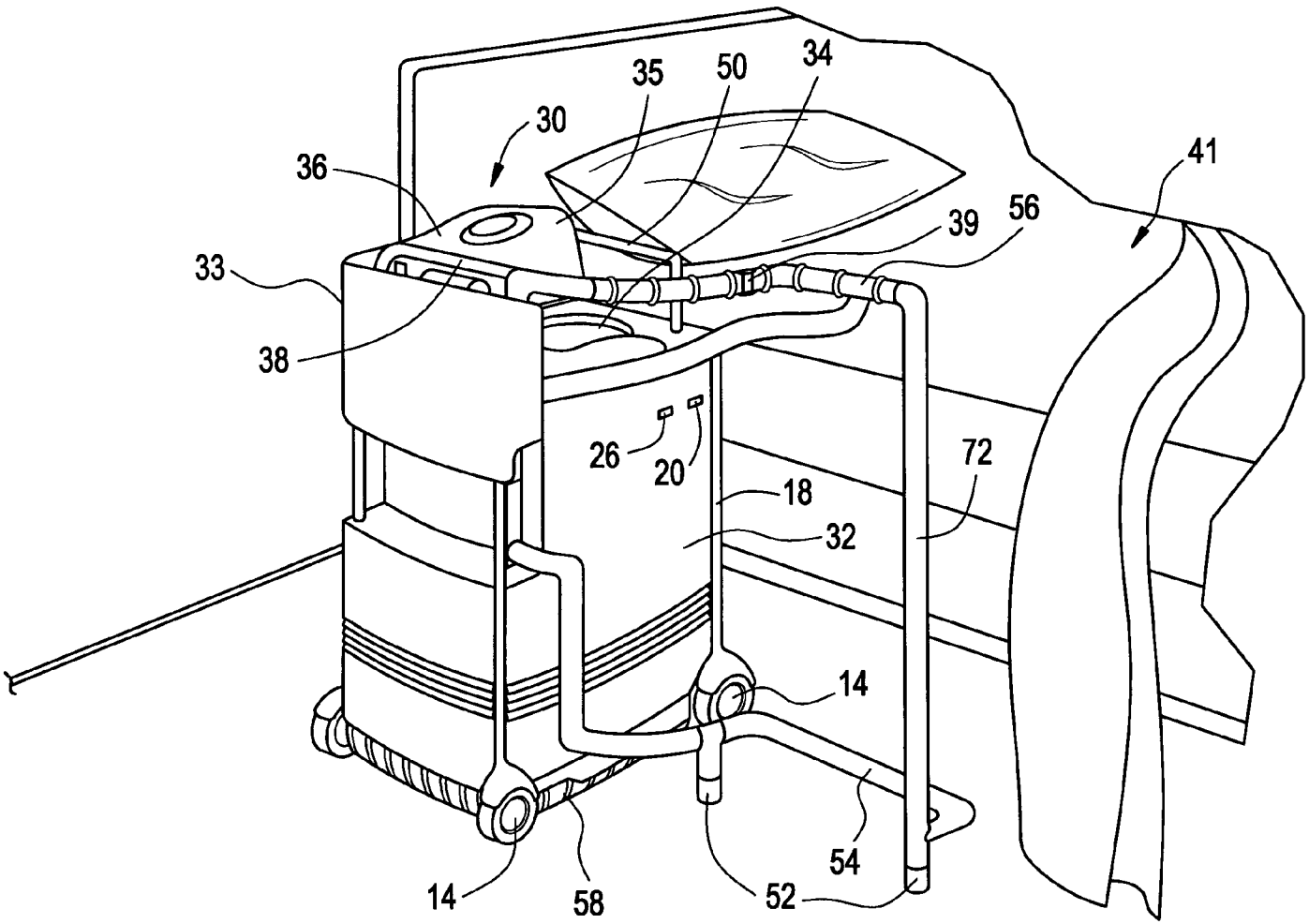
FIG. 2 is a perspective view of an embodiment of a commode of the present invention shown in an open position.

In FIG. 2 there is shown one embodiment where the unit 12 is in the form of a commode 30. The commode 30 includes a commode base 32 having a basin 26 at the top 35 of the commode base 32 for collecting waste. The basin 34 is made out of a metal or plastic material that can be sterilized after each use or disposed of. Different parts of the commode 30 can be made of a metal, a metal alloy, wood, plastic, or any other suitable material. The commode 30 can also be mostly metal to allow for greater sterility.

The commode base 32 also includes the signal receiving unit 18, the signal-transmitting unit 20, the information storage unit 16, and the homing device finder 26. The information storage unit 16 with the sensor 9 can store information about the type and weight of the contents in the basin 34, what time the commode was used and other relevant information needed by the healthcare provider/caregiver, including performing point-of-care testing (e.g., urinalysis, stool tests) and the results thereof. This information can be printed out on a slip to be added to the patient's chart, or it can be sent by the signal-transmitting unit 20 to a main station 22 where the healthcare provider/caregiver can see it.

The FIG. 2 commode is illustrated in its open form. Operatively attached to the commode base 32 is a lid 36, which also acts as a cover when the commode 30 is not in use. The lid 36 opens when the commode 30 is ready to be used. The lid 36 can sit in a slot 33 to provide stability. The commode base 32 further includes arms 38 and 50 for support and a transfer mechanism arm 39. Arm 38 prevents the user from falling off of the commode 30 by acting as a restraint.

Arm 50 deploys after the person is on the device to aid in final positioning. Arms 38, 50 and 39 sit in arm slots 43 and 45, respectively, when in the open form to provide stability. Also, arms 38 and 39 fold down around the commode base 32 when not in use or in motion. A user may support themselves on and off of the unit using hand grip 56 and foot rail 54 located on folding outrigger 72. The foot rail may take the form of a platform slightly angled and height adjustable to provide better stability for the user and, when deployed, the commode unit 30 is also stabilized. The base of the unit may include a foot 58 which engages the floor and cancels the rolling effects of the movable members 14. Also support outrigger 72 has contact with the floor at 52 and aids in the unit's frontal stability.

Figure 3:
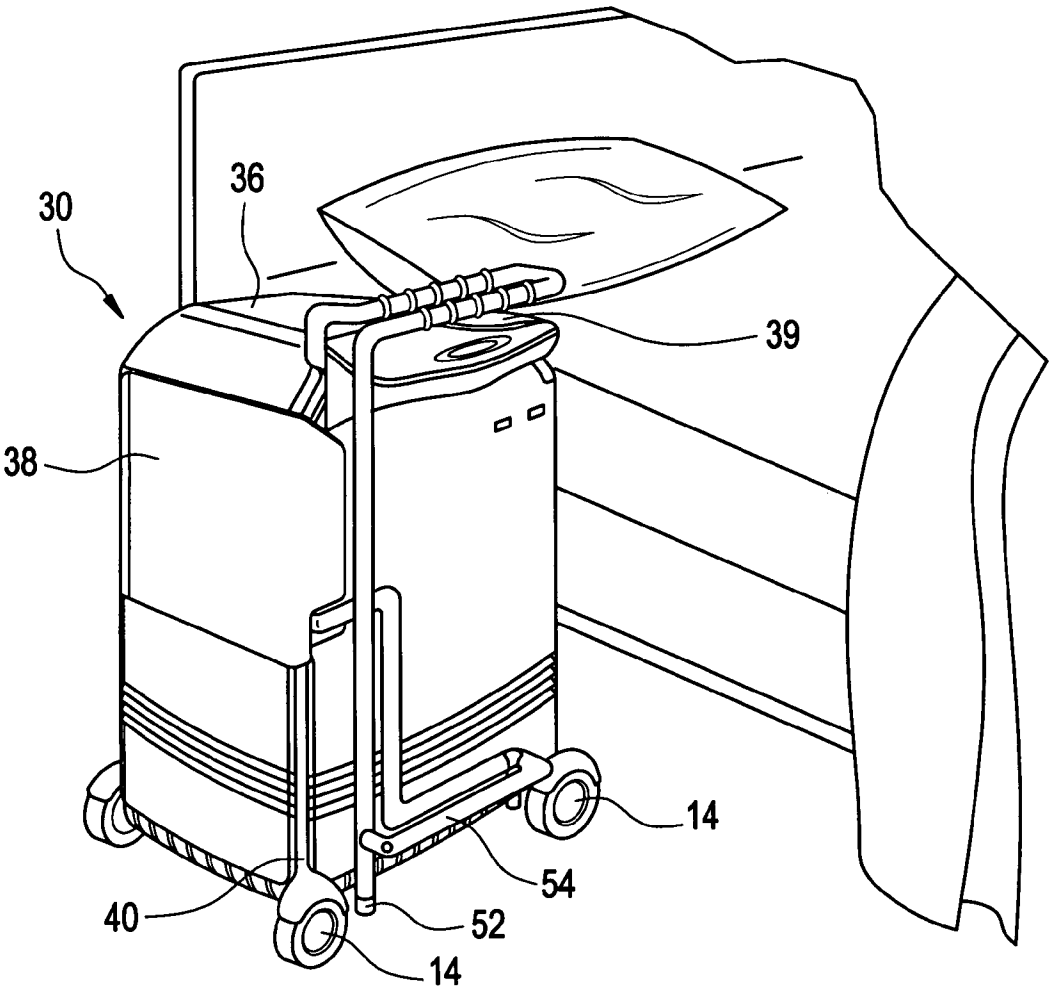
FIG. 3 is a perspective view of the commode of FIG. 2 shown in a closed position.

Turning now to FIG. 3, there is shown a compact form of a commode 30. Any suitable mechanical/electrical mechanism can be used to move the arms 38, 50, 39 and the lid 36 into position or they may be moved manually by the user. The commode 30 further includes movable members 14 allowing the commode 30 to move along the ground. The movable members 14 can be operatively attached to the commode base 32 or to legs 40. The movable members 14 can retract into the commode base 32 to obviate the need for the user to remember to set a braking mechanism, enhancing stability of the unit.

Figure 4:
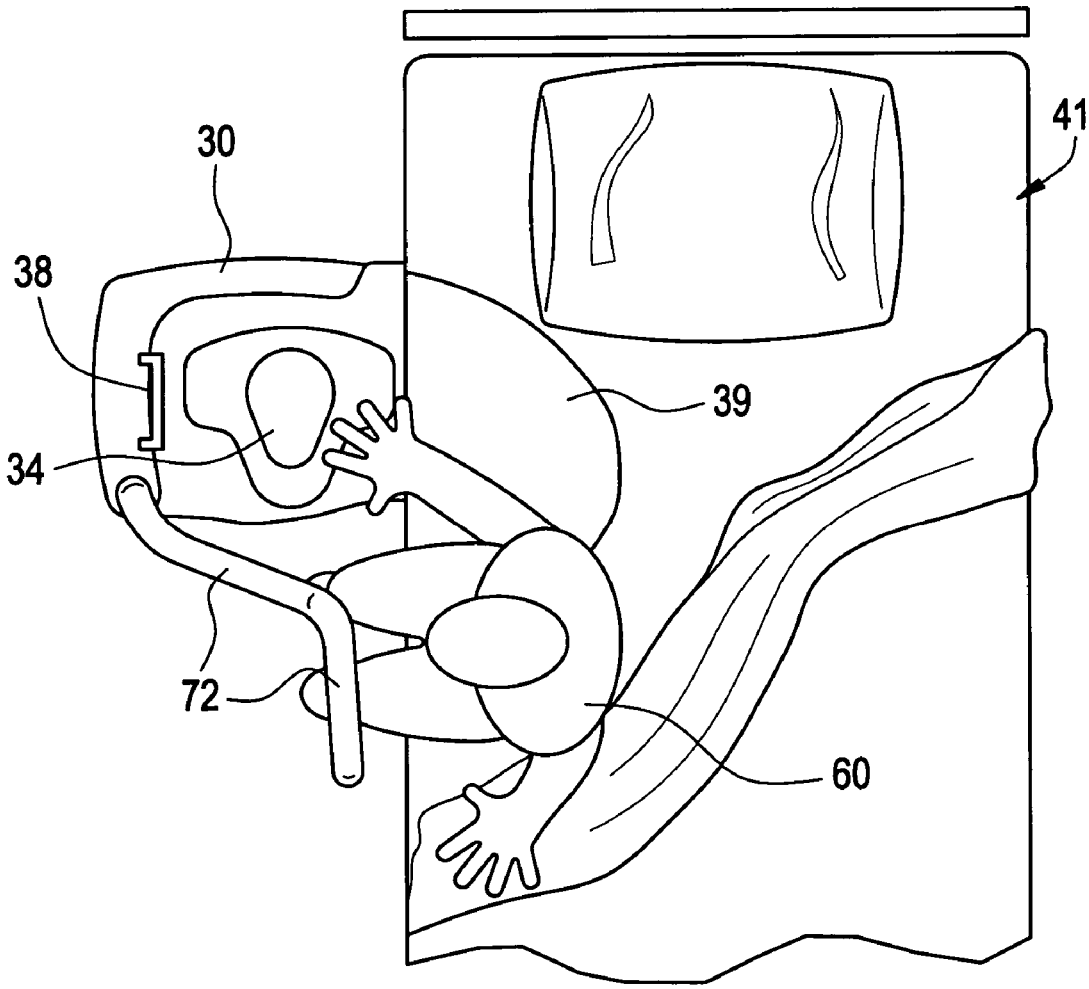
FIG. 4 is a plan view of a patient, a bed and the commode embodiment of the present invention.

Turning next to FIG. 4, there is a plan view illustrating a user 60 on a bed 41. The commode unit 30 is in the open position and the user 60 is positioned to access the unit. Arm 39 is positioned to the level of a bed 41 on which a person is laying, serving as a transfer board and allowing the person to slide onto the commode 30. Outrigger support rail 72 is used as leverage to move the user's body.

Figure 5:
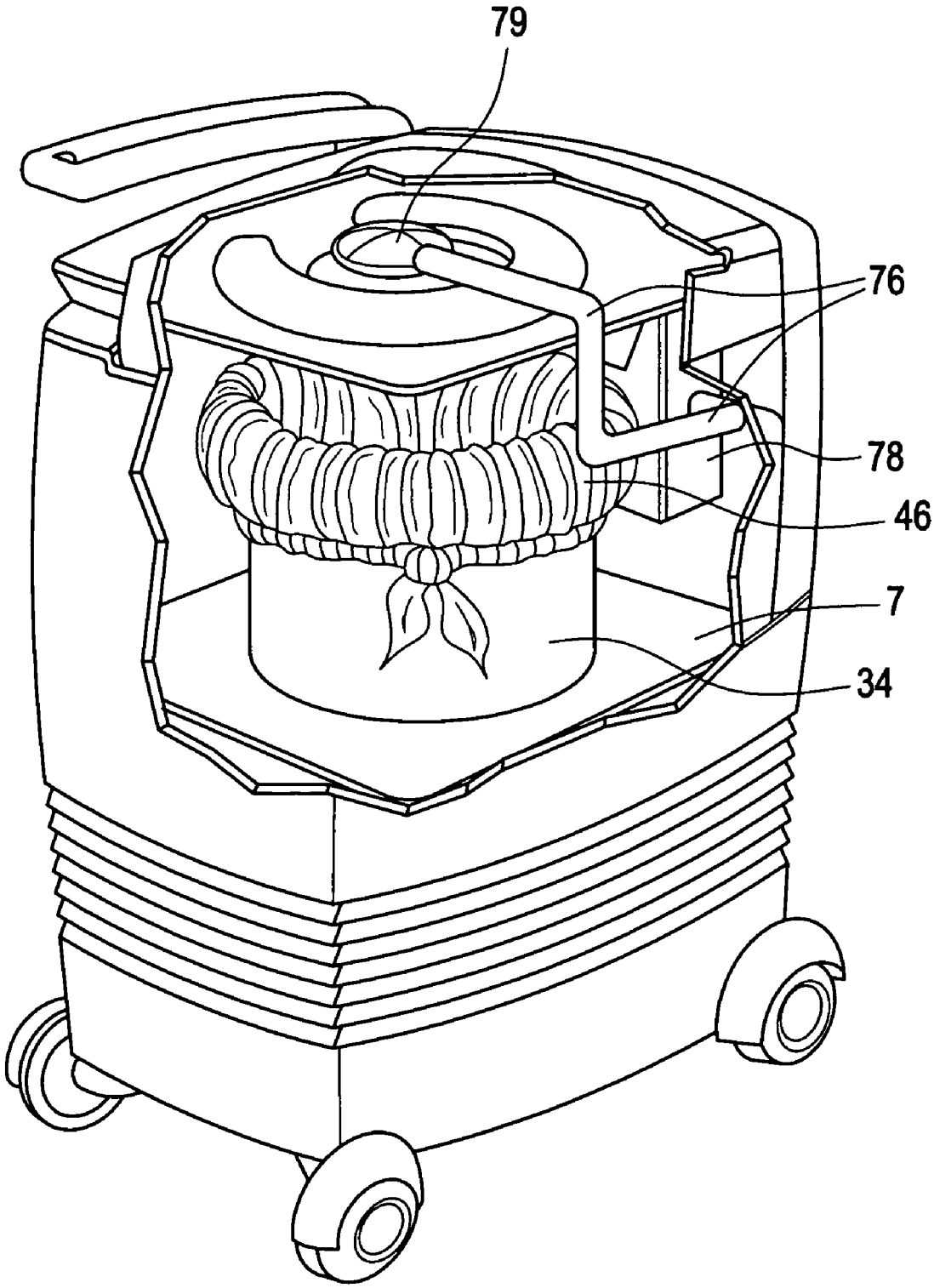
FIG. 5 is a perspective view, partially cut away, of the waste containment system usable with the commode of the present invention.

FIG. 5 shows a rear view of commode 30 with a portion of the cover cut away to view the equipment compartment 7 of the unit. The basin 34 is lined with a bag 46 to capture human waste. The bag 46 is preferably plastic and transparent for verification of the contents by the healthcare provider/caregiver; however, any other suitable material can be used. In addition, the unit can be programmed to perform point-of-care testing on the urine/feces, sending the results to the remote main station. The bag 46 may be a pre-existing purchased product originally designed for use with a 5 gallon bucket. The commode 30 can be vacuum-sealed when not in use to prevent any material from entering or leaving the commode 30, as well as to control odor. A material delivery system 76 has not been cut away in this view. This shows a system that delivers absorbent and order controlling materials to the commode basin 34 from under the lid after the unit has been used. The system is comprised of a refillable hopper 78 connected by a tube to the delivery head located under the lid. The system can be made to automatically dispense a measure amount of material directly into the basin 34 after every use.

Figure 6:
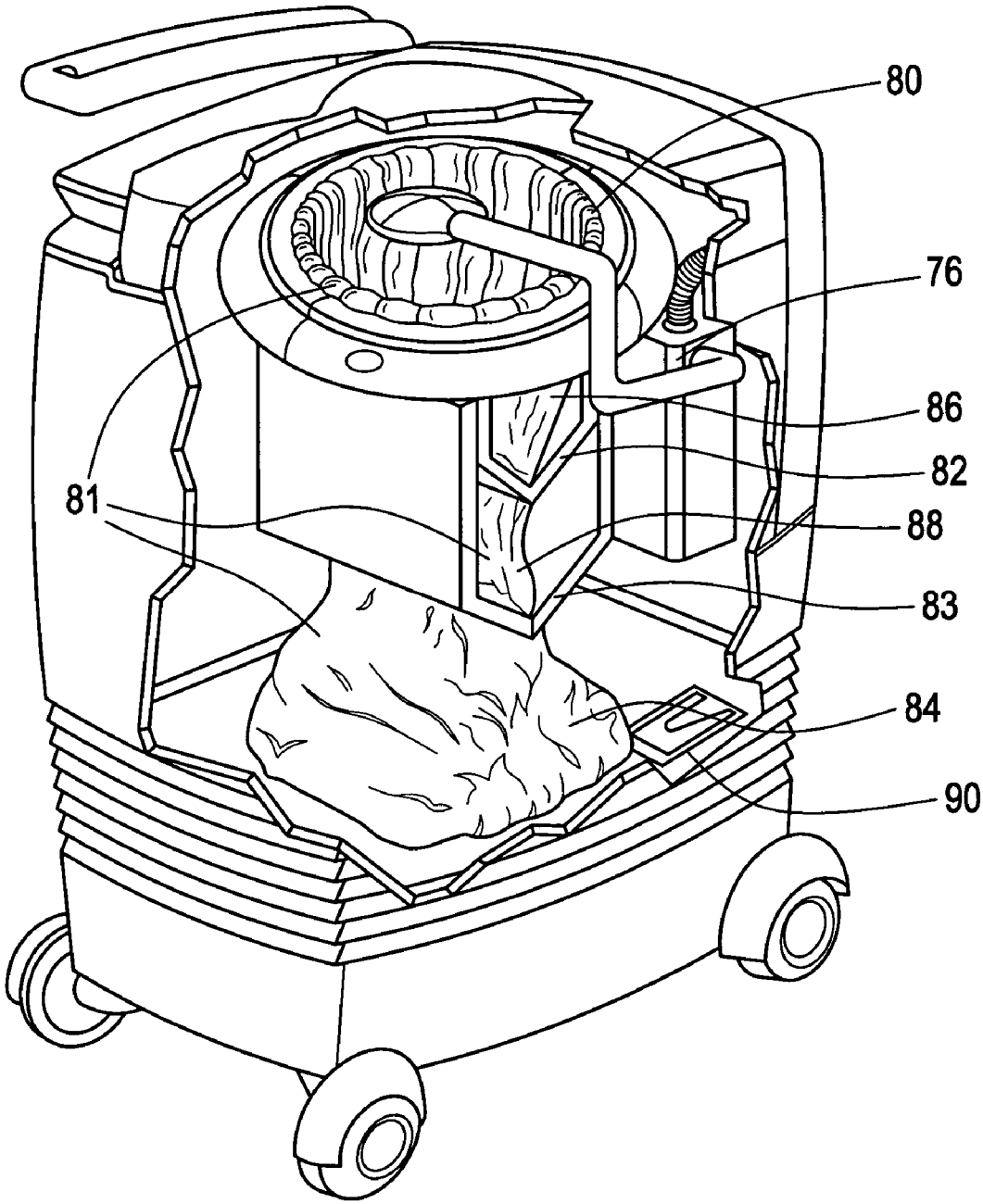
FIG. 6 is a perspective view of an alternate waste containment system usable with the present invention.

Turning next to FIG. 6, there is shown an alternative embodiment of the waste containment system of the present invention. The system includes a continuation plastic tube 81 from a replaceable cartridge 80. The plastic tube 81 is threaded in to the basin area and through the upper 82 and lower 83 seal baffles. The plastic tube 81 is knotted to form a waist containment bag at the base of the system. Human waste is deposited in the basin area 86 formed by the upper seal baffle and mix with absorbent odor controlling material deposited by system 76. The upper seal baffle then drives, by mechanical means, the waste in area 86 down through area 88 pulling new clean plastic for the cartridge 80. The lower baffles 83 clamp over the waste in 86 and seal the open top of the tube. The upper baffles retract back to their original position and the waste is locked in the containment bag 84. The unit 12 is charged with new absorbent odor controlling materials and only clean plastic exposed. It is ready for storage until the next usage. The system is created to trap odors in the containment bag 84. The bag at 84 is cut using the contained cutting tool 90 and disposed of. The remaining tube is then knotted.

Figure 7:
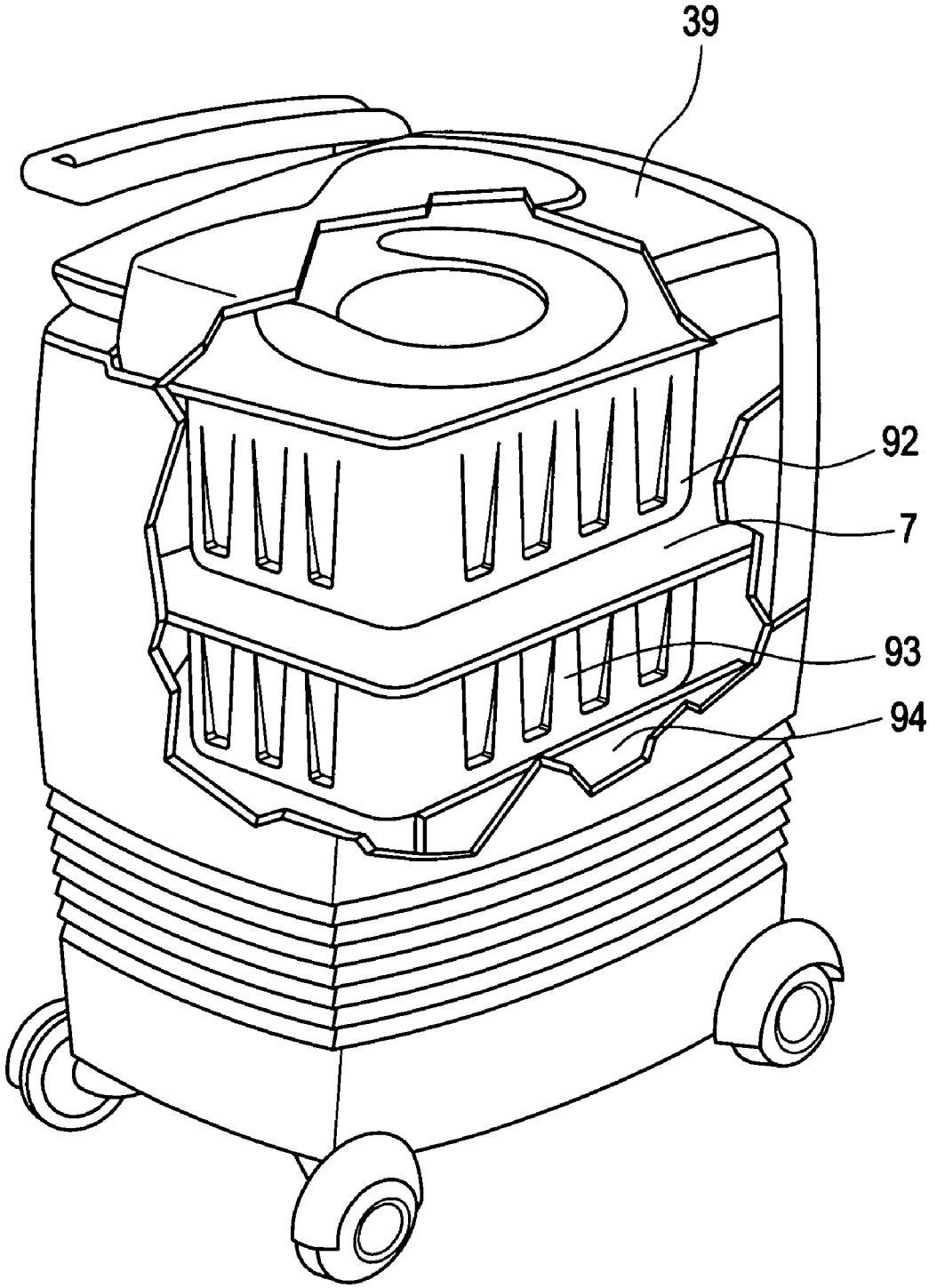
FIG. 7 is a further perspective view of an alternate cartridge waste containment system usable with the present invention.

FIG. 7 shows an embodiment of the waste containment system that utilizes disposable cartridges. The upper cartridge 92 is in use and the lower 93 is a stand by. The cartridge 92 has sealable lids 94 stored in the unit for use in the containment and disposable of the waste. The open cartridge will be sealed between uses by the commode lid 39. The cartridge contain absorbent odor controlling materials and baffling materials to prevent splash back.

Figure 8:
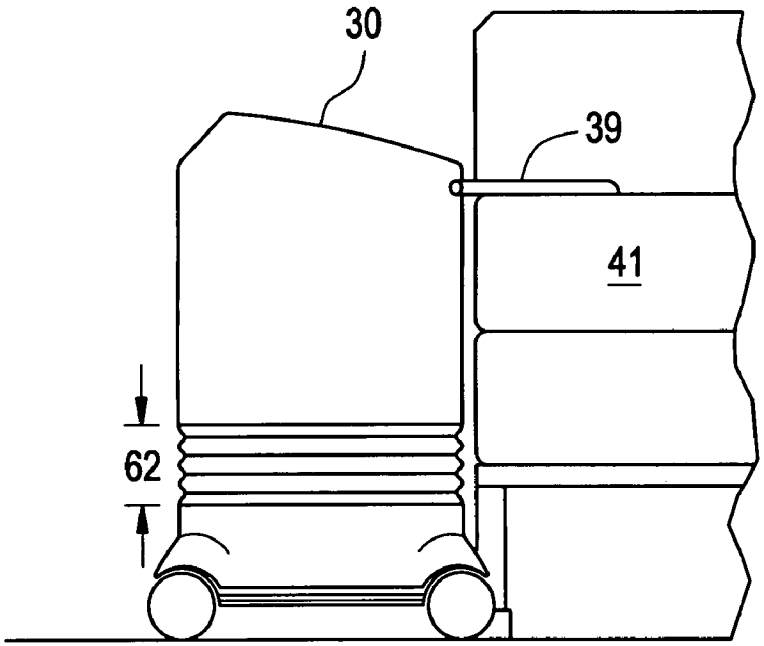

The commode 30 must align with the surface of the bed 41 in order to facilitate best opportunity for the user to maneuver onto and back off of the commode using transfer area 39. FIG. 8 and 8*a* depict the commode 30 height adjustment feature use to accommodate a range of bed heights. The device can by mechanical means raise and lower by expanding and contracting area 62.

When the person wants to use the commode 30, it can be summoned by a control 24 operated by the person. The path generally taken by the fully automated commode 30 or any unit 12 can be seen in FIG. 9, as traveling to the bed 41. The unit may travel in 360 degrees of rotation and motion in an omni directional mode. The control 24 sends an incoming signal 19 to the signal-receiving unit 18 to start movement towards the bed 41 at an in use position 66. The homing device finder 26 seeks the homing device 28 on the bed 41. The movable members 62 can retract and lower the commode 30 to the level of the bed 41. The lid 36 opens arm 39 drops sideways onto the bed and arm 38 is exposed.

The person can maneuver onto the commode 30, lift arm 50, eliminate human waste, replace arm 50 and the person can return to the bed. The person pushes the control 24 to close the lid 36 and arms 38, 39 as the commode 30 is depicted in FIG. 3. The commode 30 vacuum seals, arms and lid retract, locking/docking mechanisms break apart, movable members descend and the commode moves to a place where the healthcare provider/caregiver can check it, such as a designated place inside the person's room, or alternatively, in a hallway outside the person's room.

A light 50 located on the top 35 of the commode unit 32 can light up to notify the healthcare provider/caregiver that the commode 30 has been used. The light 50 can also be located at any location where it can be easily seen by the healthcare provider/caregiver. The commode 30 has made a record of the contents of the basin 34 as described above.

The healthcare provider/caregiver assesses the personal hygiene of the person, verifies the information given by the commode 30, and sterilizes the commode 30 according to Infection Control Procedures. A clean bag 46 or cartridge 78 stored inside the commode unit 32 can be automatically slipped into place in the basin 34 by the activation of a control panel 49 located on the commode unit 32. The lid 36 closes and the commode 30 is vacuum-sealed again until the next use. The healthcare provider/caregiver can activate the control panel 49 or the main station 22 to send the commode 30 back into the person's room where it waits to be used again.

Similar homing/locking/stability functionality can be adapted for wheelchairs, and the programmable mobile commode will function in like manner, rising to the level appropriate for the person to transfer on/off the commode safely. This same functionality can be extended to assist wheelchair bound persons to move to other surfaces, such as into car seats or other settings, by using the arm of the wheelchair in a manner similar to the use of the arm of the programmable commode.

Additional embodiments can be realized with cabinets or other fixtures, such as wash stations, refrigerators and tables. Furthermore, these fixtures can be further refined to contain movable parts themselves, such as conveyor belts or Lazy Susans so that their contents/parts can be moved into a location accessible to a non-ambulatory person who retains control via the programmable device.

The above-described embodiments have several parts or components in common. The first components in common are the movable members 14. The movable members 14 are preferably wheels with a locking mechanism for locking the unit 12 in place while the wheels are in use. The movable members 14 can also be retractable wheels that retract into the unit 12 when it comes to rest at the person's bed 41, inherently stabilizing the unit 12 at rest. Alternatively, the movable members 14 can be wheels that move along a track on the floor. The movable members 14 can be powered by a power drive. Any other suitable movable members 14 can be used. The movable members 14 can be manufactured from any suitable material by any means known in the art.

The above-mentioned embodiments also each include the information storage unit 16. The information storage unit 16 is a Computer Processing Unit (CPU) or any like unit and can be a microprocessor, use any combination of controllers, and be programmed with specific programs needed to operate the unit 30. The information storage unit 16 can include infrared and/or RFID controls, or controls for any other band as discussed below, to receive signals from other electronic devices on the unit 12 to process information and relay signals back to the electronic devices.

For example, information from the signal-receiving unit 18 can travel to the information storage device 16, causing a program to operate to move the unit 30. The information storage device 16 can also cause a signal to be transmitted through the signal-transmitting unit 18. Stored information can be analyzed and printed out by the information storage unit 16. Any suitable information can be stored, such as the time when the unit 30 moves, the time when a part of the unit 30 is accessed, or when it is cleaned by the healthcare provider/caregiver. Other information can also be stored as discussed above in the embodiment. The stored information can also be edited for accuracy by the healthcare provider/caregiver, and a record of such edits can be stored in the information storage unit 16. The information storage unit 16 can be manufactured out of any material known in the art by any process known in the art. The information storage unit 16 is easily accessible and removable for maintenance and repairs.

The above-described embodiments also include the signal receiving unit 18 and the signal-transmitting unit 20. The signal receiving unit 18 and signal transmitting unit 20 can operate in many different bands such as infrared (IR), radio frequency identification (RFID), Industrial Scientific Medical frequency band at 2.4 GHZ, RF, Ethernet local area networks (LAN), 900 MHz radio band, or any other suitable band. Infrared sensors can also be used to navigate in a room. The control 24 and the main station 22 communicate with the signal-receiving unit 18 by sending signals. The control 24 and the main station 22 can use the same signal band or operate in separate bands. The signal-transmitting unit 20 transmits outgoing signals 21 to the main station 22. The signal-transmitting unit 20 can operate in the same band as the signal receiving unit 18 and the main station 22, or it can operate in a different band. The signal receiving unit 18, the signal transmitting unit 20, the main station 22, and the control 24 can each send or accept signals with unique frequencies or encodings.

The embodiments also include the homing device finder 26. The homing device finder 26 can operate in any of the bands stated above. The homing device finder 26 can operate on a unique frequency or have a unique encoding to match a specific homing device 28. This ensures that the unit 30 does not mistakenly travel to another person's room or to any other wrong location. The homing device finder 26 and the homing device 28 can be made out of any materials known in the art and by any mean known in the art.

FIGS. 10 and 10*a* represent the movement of a semi automatic unit. The unit is positioned in a home position 62 that allows for straight unimpeded movement to the edge of the bed at the operation position 66. The user 60 from bed 41 summons the unit 30 with the remote 24 to travel 64 to the bed. FIG. 10*a* represents the unit 30 in its active mode in user position.

FIG. 11 represents a manual embodiment of a manual operated unit 30. The device will be placed by a caregiver 70 next to the bed 41 at operation location 66 at the beginning of the night for easy access by the user 60 from bed 41. The device would be attended to then after 24 hours.

FIG. 12 illustrates the flow of information and signals between the control 24, the signal-receiving unit 18, the information storage unit 16, the signal-transmitting unit 20, the main station 22, the homing device finder 26 and the homing device 28.

The invention has been described in an illustrative manner, and it is to be understood that the terminology, which has been used is intended to be in the nature of words of description rather than of limitation.

While the present invention has been set forth in terms of a specific embodiment or embodiments, it will be understood that the equipment herein disclosed may be modified or altered by those skilled in the art to other configurations. Accordingly, the invention is to be broadly construed and limited only by the scope and spirit of the claims appended hereto.

All publications, including but not limited to patents and patent applications, cited in this specification are herein incorporated by reference as if each individual publication were specifically and individually indicated to be incorporated by reference herein as though fully set forth.

What is claimed is:

1. A commode adapted to assist non-ambulatory persons to independently access said commode, said commode comprising: (a) a unit comprising a basin for receiving waste products, (b) a movable lid having an open position, wherein the commode can be used by a person and a closed position wherein waste products contained within the basin are sealed therein, (c) a transfer board, wherein the transfer board is self-contained and moveable between an in use position and a storage position and when in said in use position said transfer board enables said person to maneuver said person's self onto said commode, (d) a waste containment system to treat and isolate the waste products contained within the commode; and (e) a vertical adjustment system that allows for said person to adjust the height of the unit.

2. The commode of claim 1, wherein the waste containment system is adapted to deliver absorbent and odor controlling material into the basin.

3. The commode of claim 1, wherein the unit further comprises a dispenser of tubes, said dispenser adapted to provide a tube within the basin to receive and enclose the waste products, a lower baffle that is capable of clamping an open top of the tube after receiving the waste products, and a cutting tool to cut individual bags from the tube.

4. The commode of claim 1, wherein the waste containment system comprises at least one cartridge having a sealable lid for containing the waste products that enter the basin.

5. The commode of claim 4, wherein the waste containment system comprises a plurality of cartridges.

6. The commode of claim 4, wherein said at least one cartridge is capable of receiving an absorbent odor controlling material.

7. The commode of claim 1, wherein the unit further comprises a base having at least one outrigger that can be extended laterally outwardly from the unit, wherein the outrigger contacts the floor outwardly of the unit to provide stability for the unit.

8. The commode of claim 1 further comprising a support arm.

9. The commode of claim 1, wherein said transfer board is attached to said unit.

10. The commode of claim 1, further comprising a mechanism for receiving an instruction that the commode has been summoned, sending an alert that the commode has been used, noting that the commode has been used and transmitting information concerning contents of the commode.

11. The commode of claim 1 further comprising an information storage unit to store information electronically relating to the operation of the commode including information concerning contents of the commode.

12. The commode of claim 1 further comprising a receiving mechanism for receiving an instruction that the commode has been summoned and a signal transmitting unit to transmit signals from the commode to a remote location, including information concerning contents of the commode.

13. A mobile commode for providing a service to a person at a location, said mobile commode being designed to enable said person to independently access said commode wherein the commode comprises: (a) a base and having at least one movable member for allowing movement of the unit across a floor, (b) a basin for receiving waste product, (c) a transfer board, wherein the transfer board is self contained and moveable between an in use position and a storage position and when in said in use position enables said person to maneuver said person's self onto said commode, (d) a movable lid having an open position wherein the commode can be used by a person and a closed position wherein waste products contained within the basin are sealed therein, (e) a motive means to move the commode across a floor, (f) a signal receiving unit for receiving signals to control the motive means, (g) a control device operable by the person at the location to provide a signal to the signal receiving device to move the unit across a floor in a direction determined by the person, and (h) a vertical adjustment system that allows said person to adjust the height of the unit.

14. The mobile commode of claim 13 further comprising a sensor that determines the amount of waste products that are contained within the basin.

15. The mobile commode of claim 13, wherein the lid is openable and closable by a power system.

16. The mobile commode of claim 13, wherein the unit includes a signaling device to indicate that a person has used the commode.

17. The commode of claim 13 further comprising a support arm.

18. The commode of claim 13 further comprising an information storage unit to store information electronically relating to the operation of the commode, including information concerning contents of the commode.

19. The commode of claim 13 further comprising a receiving mechanism for receiving an instruction that the commode has been summoned and a signal transmitting unit to transmit signals from the commode to a remote location, noting that the system has been used and transmitting information concerning contents of the commode.

20. A method for self management of use of a commode, wherein said method comprises:

(a) positioning a commode next to a bed or a wheelchair;

(b) adjusting the height of said commode after (a);

(c) moving a transfer board from a storage position to an in use position, wherein said in use position enables a person to maneuver the person's self from said bed or wheelchair to said commode by maneuvering along said transfer board;

(d) depositing waste in said commode, wherein said commode comprises (i) a basin;

(ii) a movable lid, wherein said lid has at least an open position; and (iii) a waste containment system; and (e) maneuvering back from said commode to said bed or wheelchair along said transfer board.

21. The method according to claim 20, wherein said waste containment system is capable of treating and isolating said waste.

22. The method according to claim 20, wherein said commode further comprises a support rail.

23. The method according to claim 22 further comprising leveraging said person on said support rail.

24. The method according to claim 20, wherein said commode further comprises at least one support arm.

25. The method according to claim 24 further comprising supporting said person on said support arm.

26. The method according to claim 20 further comprising aligning said commode to said bed or wheelchair prior to said moving of step (c).

27. The method of claim 20, wherein said transfer board is attached to said unit.

* * * * *